United States Patent [19]

Veverka

[11] Patent Number: 4,514,606

[45] Date of Patent: Apr. 30, 1985

[54] DISCONNECT SWITCH ASSEMBLY

[75] Inventor: Edward F. Veverka, Franksville, Wis.

[73] Assignee: McGraw-Edison Company, Rolling Meadows, Ill.

[21] Appl. No.: 492,360

[22] Filed: May 6, 1983

[51] Int. Cl.[3] ..... H01H 33/12

[52] U.S. Cl. ..... 200/146 R; 200/148 R; 200/148 B; 337/4; 337/9

[58] Field of Search ..... 200/148 B, 148 R, 146 R, 200/144 R; 337/4, 9

[56] References Cited

U.S. PATENT DOCUMENTS

| | | | |
|---|---|---|---|
| 2,172,225 | 9/1939 | Schofield et al. | 200/146 R |
| 2,200,122 | 5/1940 | Rawlins | 200/146 R |
| 2,469,203 | 5/1949 | Palme et al. | 200/146 R |
| 2,480,622 | 8/1949 | Warnock | 200/146 R |
| 2,769,063 | 10/1956 | Lingal | 200/148 R |
| 4,123,637 | 10/1978 | Lott et al. | 200/148 R |

*Primary Examiner*—Robert S. Macon

*Attorney, Agent, or Firm*—Jon Carl Gealow; James A. Gabala; Hugh M. Gilroy

[57] ABSTRACT

A disconnect switch is disclosed having a puffer interrupter electrically connected with and operated by a knife switch or fused disconnect switch. A puffer interrupter includes a divided pressure chamber having at least one exterior wall which is flexible and responsive to the pressure therein. A fixed tubular electrical contact is carried by a fixed interior wall within the puffer interrupter housing so as to establish flow communication through the fixed interior wall. A floating electrical contact is carried by the flexible wall and is adapted to engage and disengage from the fixed electrical contact in response to movement of the flexible wall. A snap spring biases the floating contact away from the fixed contact during arc interruption. The knife switch carries a camming member which electrically connects the knife switch to the floating contact and which overcomes the snap spring in such a manner that the knife switch is electrically disconnected from the load before the puffer interrupter is discharged and is electrically connected to the load after the puffer interrupter is closed. Several embodiments of the abutting ends of the fixed and floating contacts and pressure chamber walls are illustrated.

10 Claims, 8 Drawing Figures

42'
46
12
40
54
52
58
50
48
41
57
32
56
39
38
64
64'
62
30
60
44

42
46
76
74
44
12'
40
52
54
48'
64
58
56
68
66
39
38
50
70
57
32
30
14

DISCONNECT SWITCH ASSEMBLY

TECHNICAL FIELD

This invention relates to the general subject of electrical switches, and more particularly, to manually operated disconnect switches and fused switches that are adapted to be opened under load.

BACKGROUND OF THE INVENTION

Disconnect switches are, for the most part, air-break, high-voltage, manually operated switches which are used for isolating high-voltage equipment, so that this equipment may be worked on safely. There are generally speaking, three basic disconnect switches. A no-load disconnect switch is not designed to interrupt any current. Its main purpose is to disconnect equipment after all current flow has been interrupted by some other means. These switches are typically single-pole knife switches which are operated by a hook stick. No-load, air-break disconnect switches are designed to break transformer magnetizing current but not any load current. These switches typically have arcing horns or auxiliary contacts so that sparking will not damage the main contacts. All arcing, during closing or opening, is designed to occur on the arcing horns. Finally, a partial-load, air-break switch is one which is designed to break a specified amount of load current. In addition to arcing horns, they typically have an arc chute or arc box to extinguish quickly the arcing produced by the load current. The present invention may be broadly classified a member of the third group of disconnect switches.

Disconnect switches of the partial-load, air-break variety have, in addition to a main switch blade, an interrupter which is designed to extinguish the arc which results when the switch is opened and to protect the main blade from being damaged by the arc. Preferably, the interrupter should be of the stored-energy variety; that is, they are opened and closed by springs so that the speed of opening or closing is not dependent upon the speed or agility of the person operating the switch. Examples of such switches are illustrated in U.S. Pat. Nos. 2,626,332 to Earle et al; 2,769,063 to Lingal; and 3,778,567 to Davies; German DE No. 3003-713 provides another example.

Knife switches incorporating a spring assist are illustrated in U.S. Pat. Nos. 556,185 to Herrick; 561,581 to Guett; and 655,047 to Bossert.

Those skilled in the art know that in an alternating current circuit, the current and voltage pass through zero amplitude every half-cycle, and that efficient operation of a load break switch is dependent upon the arc path being rendered incapable of supporting re-establishment of the arc after the power current has passed through "zero" following the breaking of the contacts under load. Thus to be effective, an arc extinguishing fluid or gas should be discharged into the arc very rapidly and the arc must be snuffed out to de-ionize the arc path or, at least, to so disperse the ions and breakup of the continuity or density of ionization so that the arc will not restrike during the circuit recovery voltage period.

The puffer interrupter is a superior device for interrupting the flow of load current. In a puffer interrupter, an arc extinguishing fluid, such as $SF_6$, is puffed into the arc formed at current cut-off by a piston and cylinder combination which is interlocked with the movable contact portion of the interrupter. U.S. Pat. No. 4,123,637 is an example of a high-voltage, high-current air disconnect switch (i.e., 230 KV, 600 Amps) incorporating a puffer-type interrupter to effect circuit interrupting prior to the disconnect switch being fully open.

Those skilled in the art also know that reliable and trouble-free operation is required of a disconnect switch and that a simplified design is preferable over a design which incorporates a multiplicity of springs or a relatively complicated operating mechanism. This is particularly true when it is realized that a disconnect switch is basically a safety device for the protection of operating personal. Therefore, a disconnect switch incorporating a reliable, easy to operate knife switch and an efficient puffer interrupter which does not require extensive maintenance (since it is basically simple in design and construction) and which could function efficiently at lower voltages (1.5 to 35 KV) would be most appreciated by both operating and maintenance personnel. It would go far towards satisfying the electrical industry's need for an improved and inexpensive disconnect switch.

SUMMARY OF THE INVENTION

In accordance with this invention a disconnect switch is provided which includes: a puffer interrupter having a fixed electrical contact and a floating electrical contact, both disposed within a bellows-like housing; a snap-action device for biasing the floating contact away from the fixed contact; and a knife switch operating device which may, as required, include a fuse, electrically in parallel with the puffer interrupter contacts when the puffer interrupter is fully closed, for overcoming the snap-action means and forcing the floating contact and the fixed contact together when the disconnect switch is closed. In particular, the puffer interrupter housing is divided by a generally rigid insulated divider plate into two separate pressure chambers. In one embodiment the housing defines at least one wall bordering each pressure chamber which is flexible and responsive to the pressure therein. The fixed electrical contact is preferably tubular in shape and establishes flow communication through and across the divider plate. The floating electrical contact is carried by one flexible wall of the housing and is adapted to engage and disengage an opening at the mating end of the fixed tubular electrical contact in response to movement of that wall. The floating electrical contact, when mated with the fixed electrical contact, plugs the flow passage across the divider plate. The knife switch carries a camming member to control the relative position of the floating contact (and the snap action device) relative to the position of the arm of the knife switch. Thus, when a closed knife switch is moved to its opened position, the knife main switch contacts are first opened without arcing, and current is fully diverted through the two contacts of the puffer interrupter which later are free to snap apart and form an arc. The rapid increase in volume on that side of the housing carrying the floating electrical contact causes a flow of arc extinguishing fluid from the other pressure chamber which snuffs out the arc.

In another embodiment, one pressure chamber is defined by a relatively rigid peripheral wall and a generally flexible cap. Other embodiments feature complimentary abutting arcing contacts. The abutting ends are shaped to enhance the arc extinguishing capabilities of the gas flowing from one pressure chamber to the other. Numerous other advantages and features of the present invention will become apparent from the following detail description of the invention and its various embodiments, from the claims, and from the accompanying drawings.

DETAIL DESCRIPTION OF THE INVENTION

While this invention is susceptible of embodiment in may different forms, there is shown in drawings and will herein be described in detail several preferred embodiments of the invention. It should be understood, however, that the present disclosure is to be considered an exemplification of the principles of the invention and that it is not intended to limit the invention to the specific embodiments illustrated. To better explain the invention, major components will be first described and then the integrated operation will be explained.

MAJOR COMPONENTS

Figure 1:
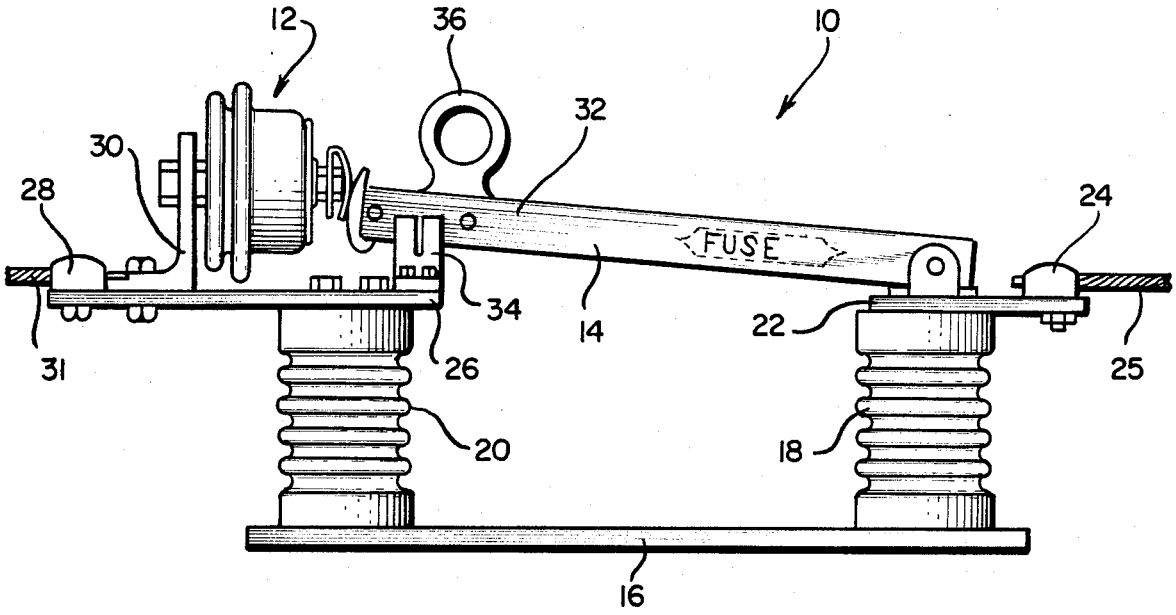
FIG. 1 is a side elevational view of a disconnect switch embodying the present invention with the switch in the closed position.

Referring to the drawings in detail, FIG. 1 is an exterior view of the disconnect switch 10 that is the subject of the present invention. In particular, the disconnect switch includes a unique bellows-like puffer interrupter 12 which, when the disconnect switch 10 is closed, is electrically connected to a knife switch 14. The switch 10 is provided with a base plate 16 which supports two insulators 18 and 20. One insulator supports an electrically conductive mounting plate 22 which supports the pivoted end of the knife switch 14 and carries a terminal 24 for connecting one end of the disconnect switch to a source of electrical power 25. The other insulator 20 carries a second electrically conductive mounting plate 26. This mounting plate supports the fixed or stationary contact of the knife switch 14, the puffer interrupter 12 and a second electrical terminal 28 for joining the switch to a load 31. As shown in FIG. 1, an L-shaped bracket 30 is used to bolt the puffer interrupter 12 to the associated mounting plate 26. The moving portion or arm of the knife switch 14 defines a set of blades 32 which are pivoted at one end to the first mounting plate 22. The free end of the blades 32 are adapted to mate with a set of fixed switch contacts or clips 34 which are bolted to the second mounting plate 26. Thus, when the knife switch 14 is closed, an electrical current passes from the power source 25 to the load 31. A hook or eye 36 is attached to the blades 32 at a position intermediate the ends of the blades so that operating personnel can open and close the knife switch 14.

Figure 2:
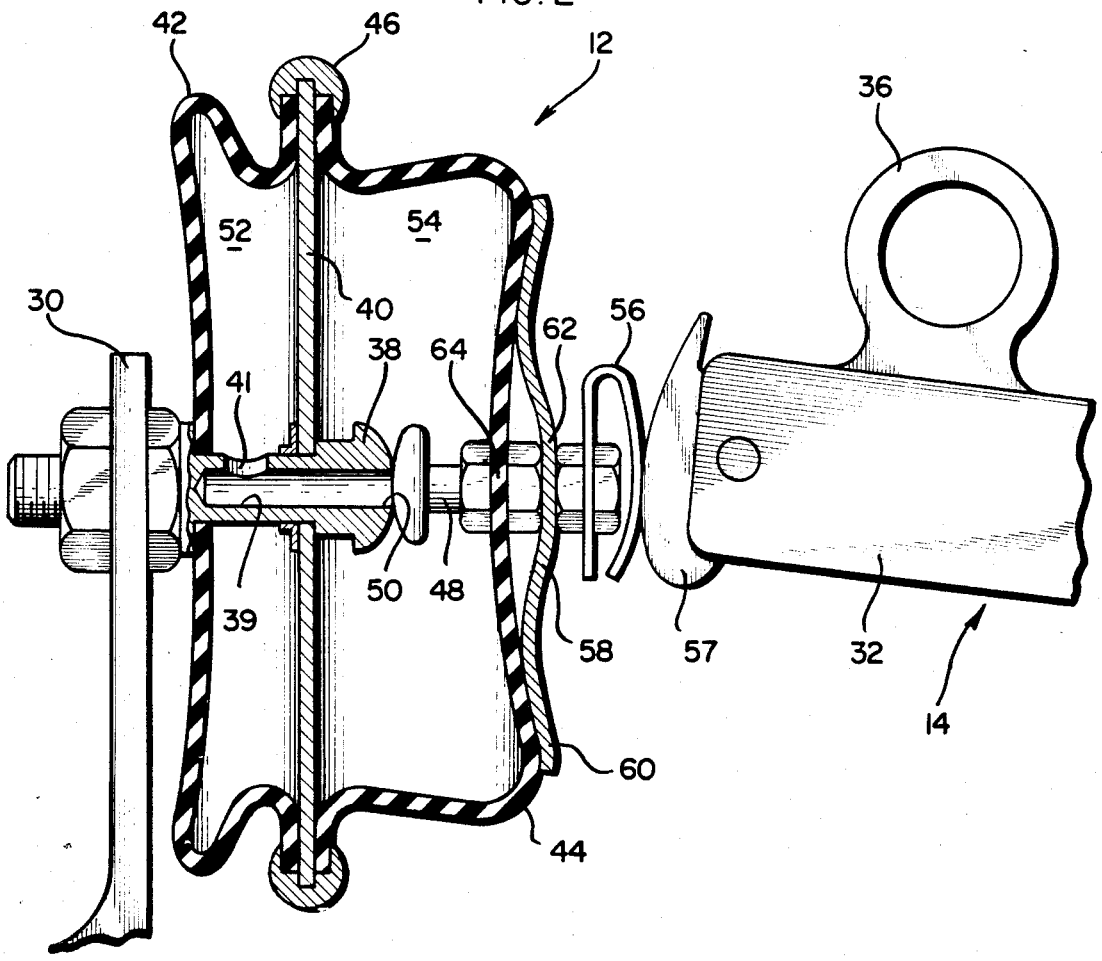
FIG. 2 is an enlarged, side elevational, cross-sectional view of two major components of the switch shown in FIG. 1.

Turning now to FIG. 2 the puffer interrupter 12 will now be described. A generally tubular fixed electrical contact 38 is bolted at one of its ends to the L-shaped support bracket 30. The fixed electrical contact 38 defines an axial bore 39 with one port or opening 50 at its distal or fixed end and a second opening 41 at is proximate end. This contact carries a generally rigid, plate-like insulating member or diaphragm 40. A generally flexible, bellows-like, elastomeric cap 42 is sealingly disposed between the proximate end of the fixed electrical contact and the periphery of the insulated diaphram 40. A similar but larger elastomeric cap 44 is sealingly disposed on the other side (the right-hand side according to the orientation of FIG. 2) of the insulated diaphragm 40. A grommet like ring holds the two caps 42 and 44 in pressure-sealing relationship with the diaphragm 40. An arc extinguishing fluid fills the interior of the interrupter (e.g., sulfur hexaflouride, $SF_6$ gas). Each cap is formed from an inexpensive elastomer such as neoprene rubber, a flexible fiberglass, or a combination of the two materials using well known molding techniques so as to insure adequate flexibility in response to internal pressure changes. As illustrated in the drawings, the right-hand cap 44 defines a generally vertical, flexible, exterior wall 64 which carries an electrical contact 48. This contact is adapted to mate with the fixed electrical contact 38 and plug the port 50 at its opened or distal end. Since this electrical contact 48 is carried by the flexible walls of the right-hand cap 44 it can be referred to as the "moving or floating electrical contact" of the interrupter 12. Thus, when this moving electrical contact 48 mates with the fixed electrical contact 38, the chamber 52 defined by the lefthand cap 42 and the insulating diaphragm 40 is sealed from the chamber 54 defined by the right-hand cap 44 and the diaphragm.

Figure 3:
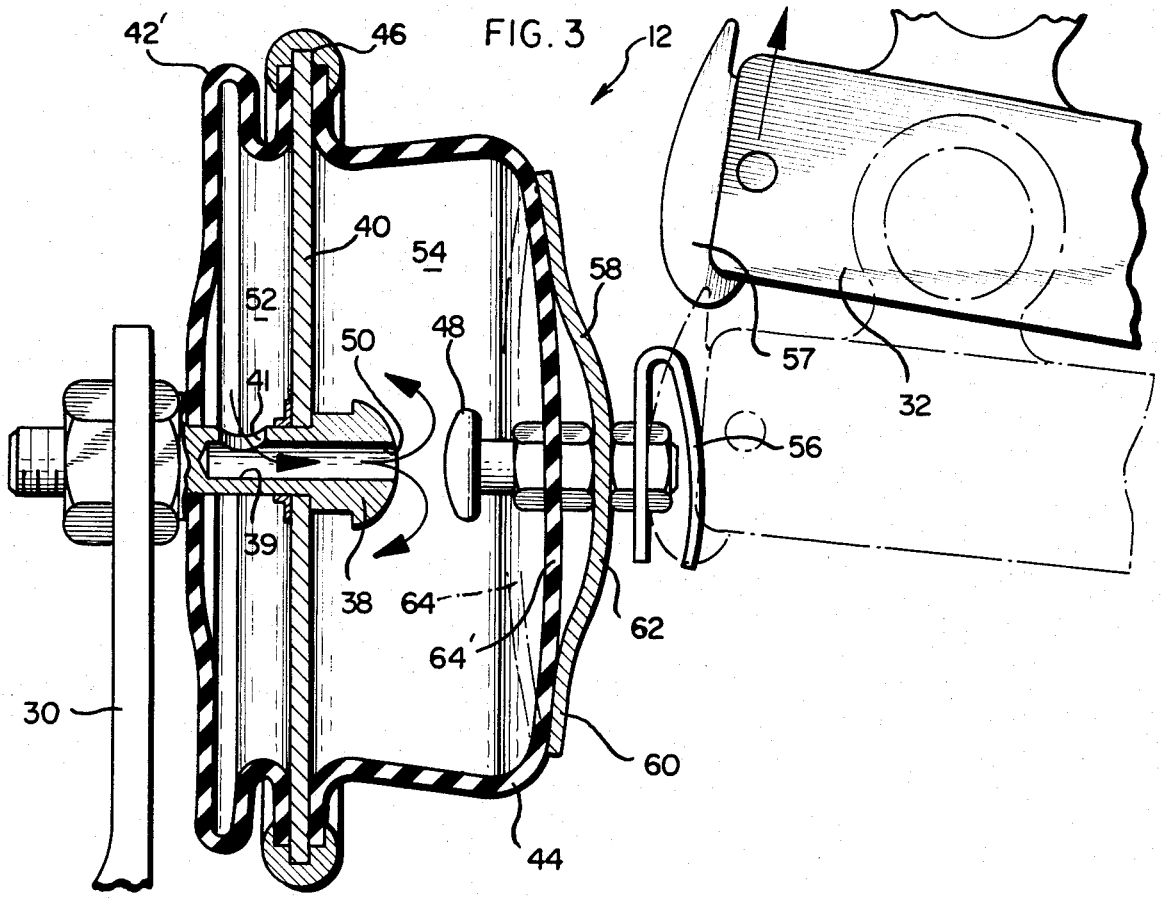
FIG. 3 is an enlarged, cross-sectional, side elevational view of the components shown in FIG. 2 after the switch has been opened.

The opposite end (the right-hand end using the orientation of FIG. 2) of the moving electrical contact 48 carries a spring-like clip 56 which is adapted to engage the free end of the blades 32 of the knife switch 14. Disposed intermediate the ends of the moving electrical contact 48 is a snap spring 58. The ends 60 of the snap spring are disposed against the exterior wall 64 of the right-hand cap 44. The mid-point or center 62 of the snap spring 58 is carried by the moving electrical contact 48 at a spaced distance from the corresponding exterior wall portion 64 of the right-hand cap 44 such that when the fixed electrical contact 38 and the moving electrical contact are mated together, the ends 60 of the snap spring are disposed generally towards (i.e., in the right-hand direction) the knife switch 14. The general shape of the snap ring 58 in its "relaxed" condition is illustrated in FIG. 3. The snap spring 58 is formed such that its central section or center 62 is bowed or dished away from its ends 60. The effect of the spring 58 is that the wall 64 of the right-hand cap 44 moves in response to the biasing force of the spring or the net force across the center of the spring. The usefulness of such a spring will become apparent after the remaining parts of the invention are explained.

The free ends of the blades 32 of the knife switch 14 are provided with a camming element 57 which is adapted to engage the contact spring clip 56. The shape of the camming element 57 relative to the floating contact spring clip 56 is such that, as the knife switch 14 is opened. There is no arcing since the contact spring clip and the camming element remain electrically connected to each other (and the fixed contact 38). After the camming element 57 passes to the edge of spring 56, the moving contact 48 separates from the fixed contact 38; the snap spring's bias is released (FIG. 3); and the arc within the right-hand chamber 54 is extinguished. The spring force or spring constant of the clip 56 is such that it maintains contact with the camming element 57 without interferring with the movement of the floating contact 48 from the fixed contact 38. In otherwords, the relative position of the floating contact 48 is initially determined by the movement of the camming element 57 and later by the snap spring 58. This again will be come clear once the operation of the disconnect switch 10 is explained.

Figure 4:
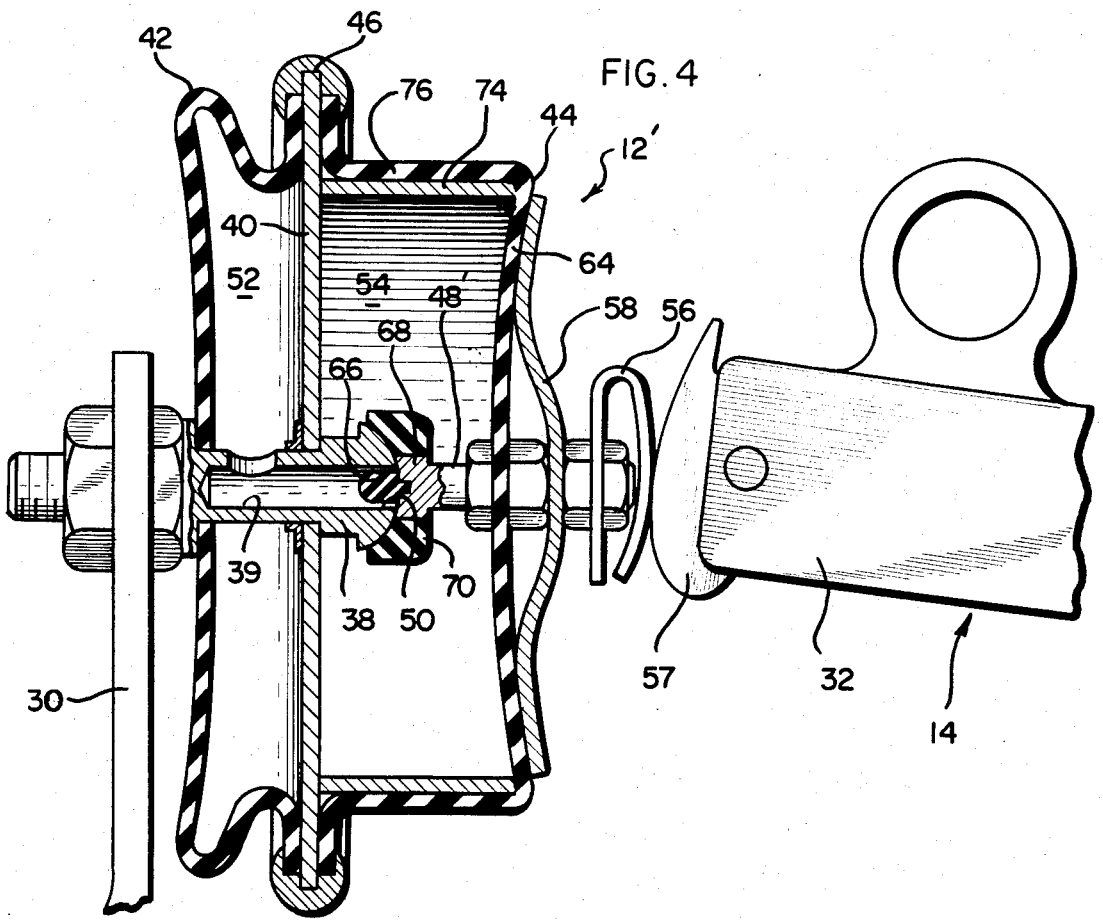
FIG. 4 is a view, much as that shown in FIG. 2, of a second embodiment of the invention.
Figure 5:
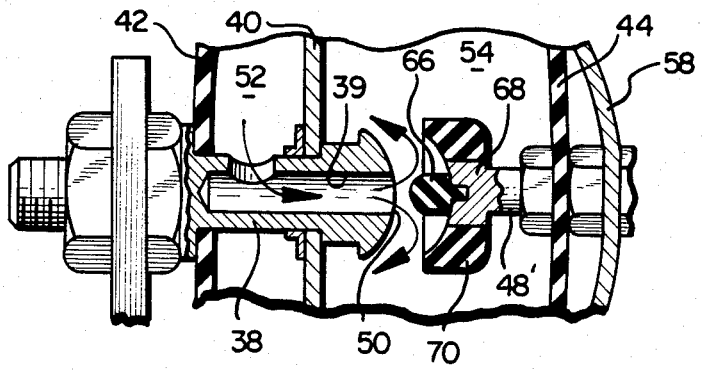
FIG. 5 is a partial, side elevational, cross-sectional view of a components of the switch shown in FIG. 4 after the switch has opened.

Before explaining the operation of the disconnect switch 10, the configuration of the abutting ends of the fixed electrical contact 38 and the floating electrical contact 48 should be noted. Those skilled in the art know that the area of the initial arc formed when two contacts are separated is limited by the relative shape and size of the channel formed by abutting ends of the two contacts. In the case of the disconnect switch 10 that is the subject of the present invention, the relationship between the camming element 57 and the spring clip 56 is such that during the first moments of circuit breaking the two contacts 38 and 48 are relatively close to each other and thus, the flow of arc extinguishing fluid from the left-hand chamber 52 through the interior of the fixed contact 38 and into the righthand chamber 54 is determined, in part, by the flow channel formed between the abutting ends of the two contacts 38 and 48 (i.e., the channel at the open end 50 of the fixed contact 38). In FIG. 2, the abutting ends of the two contacts 38 and 48 are generally mushroomed shaped. Conventional conducting materials (i.e., copper) may be used with an arc resistant material, such as tungsten, inserted in the immediate area of the arc. In FIG. 4 the fixed contact 38 is the same as that shown in FIGS. 2 and 3. Here, however, the floating contact 48' is a composite structure which includes a central portion 68 formed from an electrically conducting material and an outer portion 70 formed from insulating materials. The abutting end of this floating contact 48' is complimentary to the mushroom shaped end of the fixed contact 38. The central portion 68 of the floating contact 48' includes a plug-like, non-electrically conducting protuberance 66 which fits within the open end 50 of the bore 39 of the fixed contact 38. The overall flow pattern (see FIG. 5) of the arc extinguishing gas (see flow arrows) is somewhat improved over that when the abutting ends are simply mushroom shaped (see FIG. 3). By confining the area through which the arc extinguishing fluid must escape, the gas flow from the left-hand chamber 52 is controlled such that it has maximum effect on elongating the arc between the two contacts 38 and 48' for efficient arc interruption.

Figure 6:
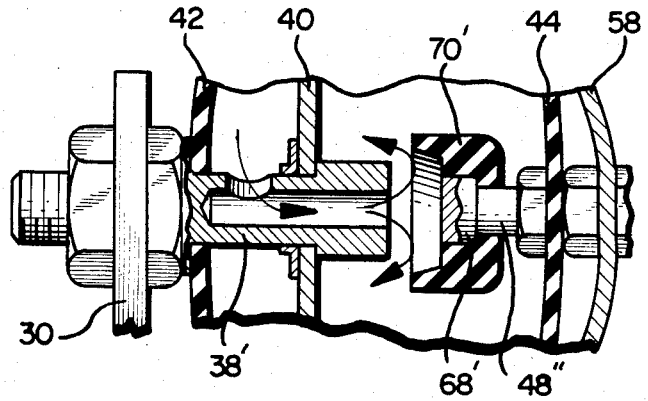
FIGS. 6, 7 and 8 are partial, cross-sectional, side elevational views, much as FIG. 5, of other embodiments of the invention.

Still another contact configuration is illustrated in FIG. 6. Here the fixed nozzle 38' has an open end in the form of a simple, right, thick-walled cylinder. The floating contact 48'' is somewhat similar to that shown in FIGS. 4 and 5 in that the abutting end includes an electrically conductive central portion 68' and a skirt-like, insulating outer portion 70'. The arc extinguishing gas released immediately following separation of the two electrical contacts is bent and accelerated by the lipped end of the insulating portion of the floating contact 48''.

Figure 7:
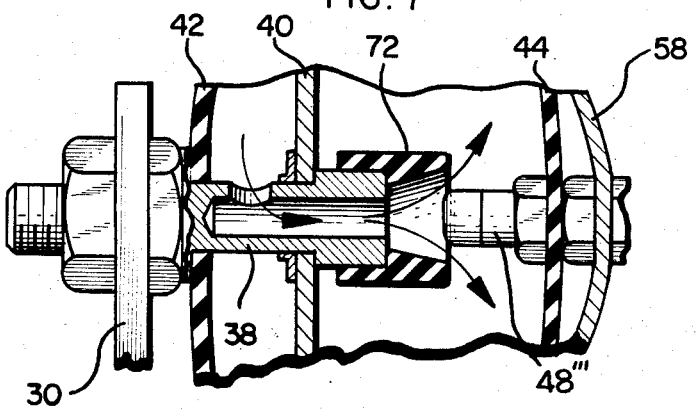

Another contact arrangement is shown in FIG. 7. Here the fixed electrical contact 38'' includes a insulating nozzle 72 while the floating contact 48'' has a solid spud-like end. This provides gas flow through a venturi type restriction.

Figure 8:
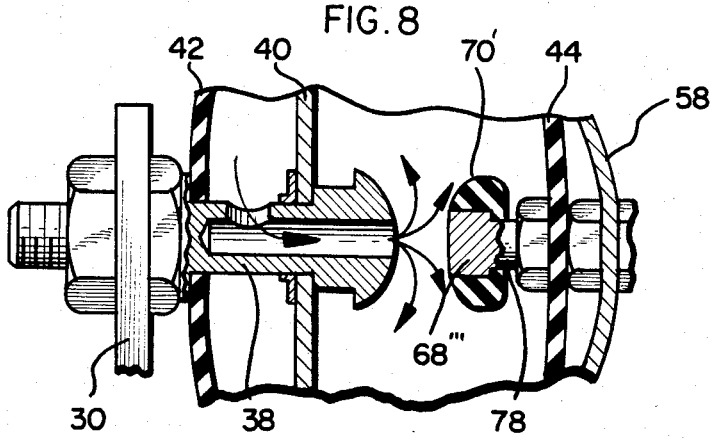

Finally, turning to FIG. 8, the final embodiment is illustrated. Here the fixed electrical contact 38 is similar to that shown in FIGS. 2, 3, 4 and 5. The floating electrical contact 78 has a general configuration of that shown in FIGS. 1 and 2 (i.e., mushroom shaped end) with the exception that it is formed from two parts: a solid electrically conductive center portion 68''' and an outer insulating member 70'. Unlike the floating contact 48' shown in FIGS. 4 and 5, the pluglike protuberance 66 is omitted. Those skilled in the art should be able to develop other shapes and configurations to adequately control the flow of arc-extinguishing fluid across the abutting ends of the two electrical contacts once the dynamic characteristics of the snap spring 58, the elasticity of the right-hand cap 44 and left-hand chamber 42, and the voltage and current range of the switch are specified.

OPERATION

Now that the principal components of the invention have been described in detail, the overall operation of the disconnect switch 10 will be discussed so that the unusual, unique and synergistic affects of the various components will be better understood. Turning to FIG. 2, the disconnect switch 10 is operated by inserting a hooked pole into the eye 36 of knife switch 14. As the blades 32 are drawn away from the contact clips 34, the flow of current through the disconnect switch 10 flows exclusively through the closed puffer interrupter 12. The camming element 57 remains electrically in contact with the spring clip 56.

After the blades 32 pass across the exterior end (i.e., over-center) of the floating contact 48, the floating contact is free to move away from the fixed contact 38. When the force supplied by the camming element 57 to the spring clip 56 is overcome by the spring force of the snap spring 58, the snap-action effect rapidly separates the abutting end of the floating contact 48 from the fixed contact 38. The shape of the camming element 57 relative to the spring clip 56 allows the floating contact 48 to rapidly move to the right without physical interference. The relative position of the moving components is shown in FIG. 3.

In addition to rapidly separating the two electrical contacts, the snap spring 58 deflects or displaces the vertical exterior wall 64 from the position shown in FIG. 2 to that position shown in FIG. 3. This displacement is analogous to the right-hand movement of a piston within a fixed cylinder. Because of the change in volume, arc extinguishing fluid from the left-hand, expanded, elastic chamber 52 is free to flow into the right-hand chamber 54. This, in turn, reduces the volume of the left-hand chamber 52. Effectively, the left-hand cap 42' assumes a "collapsed" configuration relative to the initial "expanded or charged" configuration 42 shown in FIG. 2.

During the closing operation of the disconnect switch 10 the sequence just described is reversed. When the knife switch 14 is closed, the force applied through spring 56 compresses spring 58 and rapidly forces the two puffer contacts 48 and 38 together and decreases the volume of the right-hand chamber 54. This allows the puffer interrupter contacts 38 and 48 to close. They will momentarily carry the entire flow of current through the switch until the blades 32 of the knife switch 14 come into contact with the stationary contacts 34 on the mounting plate 36. The rapid collapse of the right-hand chamber 54 effectively "pumps" fluid into the previously collapsed left-hand chamber 52.

From the foregoing, it should be apparent that numerous variations and modifications maybe effective without departing from the true spirit and scope of the novel concept of the invention. For example, FIG. 4 shows a puffer interrupter 12' wherein the right-hand pressure chamber 54 is formed from an elastomeric cap 44 drawn over a rigid, open-ended cylinder 74. In this embodiment the horizontal walls 76 of the end cap 44 remain essentially stationary while the vertical exterior wall 64 is free to move in response to the snap spring 58. Effectively, the entire change in volume of the right-hand chamber 54 is due to the displacement of the vertical wall 64. In the previous embodiments the horizontal exterior walls of the right-hand pressure chamber were free to flex in response to the internal pressure within the right-hand pressure chamber 54. The same affect could, of course, be produced by rigidifying or strengthening the periphery of the right-hand cap (i.e., making the peripheral portions stronger relative to the center of the exterior wall 64). In another variation the left-hand cap 42 may be formed from generally rigid walls. Those skilled in the art know the pressure and volume relationships associated with the operation of a puffer interrupter and can decide if such a cap would be appropriate. Thus, it should be understood that no limitations with respect to this specific apparatus illustrated herein is intended or should be inferred. It is, of course, intended to cover by the appended claims all such modifications as fall within the scope of the claims.

What is claimed is as follows:

1. A disconnect switch assembly, comprising:

(a) a fixed electrical contact, defining a free end and a fixed end, having hollow bore open to said free end and an opening, communicating with said bore, which is disposed intermediate the ends of said fixed contact;

(b) a two-sided divider plate carried by said fixed contact and disposed intermediate the ends of said fixed contact with said opening on one side of said plate;

(c) wall means, adapted to be filled with an arc extinguishing fluid and in flow communication with said opening, for forming a volume chamber on said one side of said divider plate;

(d) a two-ended movable electrical contact having one end which is adapted to engage and disengage with said free end of said fixed contact so as to plug that end of said bore when said fixed and movable electrical contacts are engaged;

(e) expansion chamber means, carried by the other side of said divider plate and in flow communication with the free end of said fixed contact, for carrying said movable contact relative to said fixed contact and for changing the volume of the fluid on the other side of said divider plate in response to the position of said movable contact relative to said fixed contact;

(f) snap-action means, carried by said movable contact, for rapidly disengaging said movable contact from said fixed contact;

(g) releasable operating means, adapted to engage with and make electrical contact with the other end of said movable contact and to make electrical contact with said fixed electrical contact, for overcoming said snap-action means and forcing said fixed contact and said movable contact together and for shunting said fixed electrical contact and said moving electrical contact; and (h) camming means, caried by said snap action means and said releasable operating means, for breaking the shunt across said fixed and moving electrical contacts before separating said fixed and moving electrical contacts and for mating said fixed and moving electrical contacts before shunting said contacts, whereby upon the release of said operating means, said snap-action means quickly separates said fixed and said movable electrical contacts and, in the event that current is passing through said fixed and moving contacts, an electrical arc is formed across said contacts, the arc drawn across said contacts being extinguished by the fluid flowing from said volume chamber into said expansion chamber means through the bore in said fixed contact.

2. The switch assembly set forth in claim 1, wherein said wall means is elastic such that the volume chamber defined by said wall means and said divider plate changes in volume response to the pressure therein.

3. The switch assembly set forth in claim 1, wherein said releasable operating means includes a knife switch defining:

a first contact which is electrically connected to the other end of said movable electrical contact;

a second contact which is electrically connected to said fixed electrical contact; and a moving arm which is pivotably fixed at its proximate end and which has its distal end adapted to engage said first contact and said second contact, said arm being adapted to move between a closed position where said arm, said first electrical contacts and said second contact are electrically connected and an open position where said first and second contacts and said arm are electrically disconnected, whereby said switch assembly is operated by moving said arm between its open position and its closed position.

4. The switch assembly set forth in claim 3, wherein said moving arm is adapted to separate from said first electrical contact after said arc is extinguished.

5. The switch assembly set forth in claim 3, wherein said first contact is a spring clip and wherein the distal end of said moving arm defines a cam adapted to maintain said arm and said spring clip electrically connected until said arc is extinguished.

6. A switch assembly, comprising:

(a) a generally rigid, fixed plate defining a first side and a second side and a tubular flow channel between said first side and said second side;

(b) pressure responsive wall means, carried on said one side of said plate and in flow communication with said flow channel, for forming a first chamber on one side of said plate;

(c) second wall means, carried on the other side of said plate and in flow communication with said flow channel, for forming a second chamber on said second side of said plate, said first and second chambers being adapted to be filled with arc-extinguishing fluid;

(d) a first electrical contact disposed on said one side of said plate with said flow channel passing therethrough;

(e) a floating electrical contact means, carried by said pressure responsive wall means and adapted to engage and disengage with said first contact, for plugging said tubular flow channel when said fixed contact and said floating contact means are engaged and for providing an electrical flow path through said pressure responsive wall means;

(f) snap-action means, carried by said pressure responsive wall means, for rapidly disengaging said floating contact means from said fixed contact; and (g) releasable operating means, adapted to engage said floating contact means, for overcoming said snap-action means and for forcing said fixed contact and said floating contact together.

7. The switch assembly set forth in claim 6, wherein said pressure responsive wall means defines an elastomeric wall which is disposed generally parallel to said plate.

8. The switch assembly set forth in claim 6, wherein said second wall means is elastomeric.

9. A switch assembly, comprising:

(a) a pressure housing divided into two compartments by a generally rigid fixed interior wall, said housing having at least one exterior wall on each side of said fixed interior wall which is flexible and responsive to the pressure therein, whereby an increase in the internal pressure within any compartment causes the associated exterior wall to flex;

(b) a fixed tubular electrical contact carried by said fixed interior wall and having an opening establishing flow communication across said fixed interior wall;

(c) a floating electrical contact, carried by said one exterior wall in one of said compartments and adapted to engage and disengage said fixed electrical contact in response to the movement of said one exterior wall, for plugging the opening through said interior wall;

(d) over-center means, carried by said housing, for biasing said floating contact away from said fixed contact; and (e) operating means, adapted to engage said floating contact, for overcoming said over-center means and forcing said floating contact and said fixed contact together to plug the opening across said interior wall, said operating means having an engaged position where said fixed and said floating contacts abut one another, a disengaged position where said fixed and said floating contacts are separated, and an intermediate position where said fixed and said floating contacts are separated and said operating means is engaged with said floating contact.

10. The switch assembly set forth in claim 9 wherein the operating means includes a fuse.

* * * * *